United States Patent [19]

Wild

[11] Patent Number: 4,608,804

[45] Date of Patent: Sep. 2, 1986

[54] BOTTLE GUIDE SUPPORT ASSEMBLY

[76] Inventor: Anton J. Wild, 182 Blvd., Kenilworth, N.J. 07033

[21] Appl. No.: 731,427

[22] Filed: May 7, 1985

[30] Foreign Application Priority Data

May 8, 1984 [DE] Fed. Rep. of Germany ..... 3416962

[51] Int. Cl.[4] ..... B65B 21/14; B65B 39/00

[52] U.S. Cl. ..... 53/262; 53/248; 53/255

[58] Field of Search ..... 53/247, 248, 255, 261, 53/262, 239

[56] References Cited

U.S. PATENT DOCUMENTS

| | | | |
|---|---|---|---|
| 3,271,928 | 9/1966 | Wild | 53/255 |
| 3,325,967 | 6/1967 | Wild | 53/255 |
| 3,788,034 | 1/1974 | Hartness et al. | 53/248 |
| 3,911,647 | 10/1975 | Hartness et al. | 53/248 |
| 4,033,095 | 7/1977 | Wild | 53/248 |
| 4,170,096 | 10/1979 | Wild | 53/248 |
| 4,207,721 | 6/1980 | Raudat et al. | 53/248 |
| 4,439,974 | 4/1984 | Wiseman | 53/248 |
| 4,448,009 | 5/1984 | Raudat | 53/248 |
| 4,473,987 | 10/1984 | Wild | 53/255 |

*Primary Examiner*—John Sipos
*Assistant Examiner*—Donald R. Studebaker
*Attorney, Agent, or Firm*—Sperry, Zoda & Kane

[57] ABSTRACT

A bottle divider grid assembly including a plurality of lower dividers for channeling downwardly moving bottles into specified arrays with plastic and/or metal guiding fingers secured onto guide support assemblies, secured into slots defined in the upper and/or lower portions of the lower dividers. The guide support assemblies are removable for maintenance in a manner specifically facilitated by easily removable locking devices. These locking devices are made easily removable by usage of a spring plunger device or a simple single screw which allows complete removal of the guide support assemblies. Also, there can be divider panels positioned immediately above the lower dividers to guide the bottles neatly on the bottle supply conveyor into paths which are then guided downwardly by the guide support assemblies into the pre-chosen arrays. The upper dividers or plates are secured in spaced relationship with respect to one another by a lateral retaining device, which has secured thereto an alignment device such as a pin device which makes them extend downwardly therefrom into predefined apertures within the carriage which holds the lower divider plates in spaced relationship with respect to one another. The lower edges of these upper plates when placed downwardly into the channel defined by the guide support assemblies will lock the guide support assemblies in place. Alternatively, this locking engagement can be utilized without the lower edges of the upper plate by providing securement apertures in the lower dividers through which the above defined spring plunger or single screw can extend. The male end of the screw will protrude into the securement aperture to allow removal or replacement of the support assembly by merely removal of a single screw. Alternatively, the usage of the spring plunger design will allow instant removal of the guide support assembly by moving upward when the slots are defined in the upper edge of the divider and downwardly when the slots are defined in the lower edges of the dividers.

24 Claims, 14 Drawing Figures

BOTTLE GUIDE SUPPORT ASSEMBLY

BACKGROUND OF THE INVENTION

1. Field of the Invention

The present invention deals with the field of devices for packing of bottles which are traveling in random orientation upon a supply conveyor. The packer requires a grid for placement of the bottles into the predefined array of the packing case located immediately there below. Such devices often require extensive maintenance and the present invention provides the means for facilitating the most commonly occuring maintenance repairs.

2. Description of the Prior Art

Many devices are currently being used for orienting bottles into packing cases such as U.S. Pat. No. 3,325,967. In this design as bottles are supplied, the downwardly guiding fingers place them into the predefined holes in the case 8 located there below.

To facilitate the downward guiding, fingers such as shown in U.S. Pat. No. 4,170,096, have been configured which themselves can be removed from the guiding support. It has been found that it is much easier to replace four guiding fingers simultaneously by simple removal of the entire guide support assembly as is capable with the present invention.

SUMMARY OF THE INVENTION

The present invention includes a bottle divider guide assembly which is capable of simple and easy disassembly, and is adapted to receive bottles randomly positioned upon a supply conveyor. The grid assembly includes a lower divider means having a plurality of lower plates, spatially disposed parallel with respect to one another and extending longitudinally in relationship to the direction of movement of the bottles traveling on the bottle supply conveyor. The lower plates define a plurality of slots there which extend from the upper or lower edges thereof.

The guide support assemblies of the present invention will include an aperture extending thereto into which can be placed a screw or a spring plunger device. A mated securement aperture will be defined in the lower divider means into which this spring plunger can selectively extend. Once the guide support assembly has been placed with the channel means thereof completely engaged with respect to the slot means of the divider plate, the spring plunger means will be oriented immediately adjacent to the securement aperture means in the divider plate. This configuration is achieved whether the slot means 20 is defined in the upper edge of the divider means or in the lower edge of the divider means. Each configuration is equivalent, however, removal of course would be downwardly if the slot faces downward and upwardly if the slot faces upwardly.

The spring plunger includes a spring biased member adapted to protrude or snap into the securement aperture when positioned thereadjacent. This will allow easy snap-in or easy snap-out of the grid support assembly with respect to the divider plate to facilitate maintenance and other services.

In the alternative configuration, the spring plunger means will be replaced by a screw means which can selectively be screwed into the securement aperture means when it is positioned adjacent to the screw means by movement of the guide support assembly completely into place into the slot of the divider plate. This allows simple and easy removal of the guide support assembly with respect to the lower divider means merely by loosening of a single screw.

A number of guide support assemblies which each define a channel means extending vertically therethrough, are removably mounted into the defined slot means on the lower plate. It is the channel means which is vertically engageable with respect to the slot means for securing the guide support assemblies in place.

Each of these guide support assemblies includes plastic and/or metal guiding fingers extending downwardly along each of the opposite four side faces with two on each side of the lower plate on which the guide support assembly is mounted. The slots on the lower plate are positioned such as to define an array of bottle guiding paths extending downwardly thereadjacent. The chosen array can be 2×3, 3×4, 4×4, 4×6, or multiple 4×6's.

In an alternative configuration which includes an auxiliary upper locking means, an upper divider means includes a plurality of upper plates spatially disposed parallel with respect to one another, and extending longitudinally with respect to the direction of movement of the bottle supply conveyor and oriented immediately above and adjacent to the lower plate. The upper plates are engageable with respect to the guide support assemblies by extending into the channel defined therein to urge the guide support into secured position retained in the slot means of the lower plates.

Also, a lateral retaining means is included secured with respect to each of the upper plates to maintain them into secured spaced relationship with respect to one another, and to facilitate removal of each of the upper plate means simultaneously for selective removal and replacement of whichever guide support assemblies may include broken guiding fingers or broken resilient reinforcement means which are positioned immediately behind the guiding fingers. Also, an alignment means is secured with respect to the upper divider means to maintain correct orientation between the upper plate means and the lower plate means. This alignment means may include a pin means which is secured with respect to a carriage means, and is adapted to the position extending into the alignment apertures to retain the upper plate means parallel to and immediately above the lower plate means. The carriage means maintains spaced orientation between the lower plate means.

The lower divider means may preferably include a first lower section and a second lower section, each including guide support assemblies mounted in the slots thereof to define 2×3, 4×4, and 4×6 arrays of bottle receiving paths. Similarly, the upper divider means may include a first upper section and a second upper section with the first upper section positioned immediately above and parallel to the first lower section, and a second upper section positioned immediately above and parallel with respect to the second lower section. With this configuration, two 2×3, 4×4, and 4×6 arrays of bottle guiding paths will be defined for packing two 2×3, 4×4, and 4×6 arrays of bottles simultaneously to increase packing speed.

It is an object of the present invention to provide a bottle guide support assembly capable of simple and efficient complete disassembly.

It is an object of the present invention to provide a bottle guide support assembly with upper divider plates which secure guide support assemblies and guiding fingers in position.

It is an object of the present invention to provide a bottle guide support assembly having upper divider plates which can be removed in one motion, providing immediate access to extremely simple removal of individual guide support assemblies holding four guiding fingers and four reinforcement means each.

It is an object of the present invention to provide a bottle guide support assembly which is easy to maintain.

It is an object of the present invention to provide a bottle guide support assembly which has a basic construction which facilitates removal and replacement of individual guide support assemblies.

It is an object of the present invention to provide a more cost efficient bottle divider grid assembly.

It is an object of the present invention to provide a bottle guide support assembly which has significantly increased bottle packing speed capacities.

It is an object of the present invention to provide a bottle guide support assembly with novel means for providing immediate access to removal of each and every plastic and/or metal guiding finger and resilient reinforcement means.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 2:
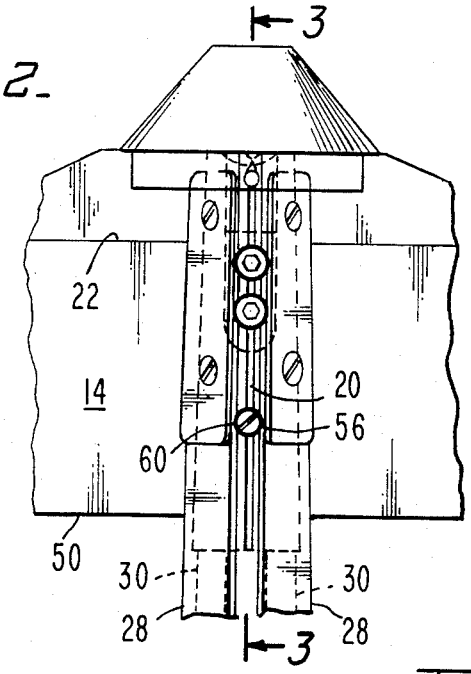
FIG. 2 is a cross sectional view of an embodiment of the bottle guide support assembly of the present invention with the slots located in the upper portions of the lower divider means.

The present invention provides a bottle divider grid assembly usable for receiving bottles 10, traveling in random locations upon a bottle supply conveyor 12. The conveyor will carry the bottles in direction 18 adjacent to the location of lower divider means 14.

The lower divider means 14 includes slot means 20 defined in the lower most edges 58 or in the upper most edges 22 thereof. As shown in FIGS. 2, 3, 4, 5, 6, 7, 8, 9, and 14 when the slot is located in the upper most edge 22, the guide support assembly 24 will be placed downwardly therein. On the other hand, if the configuration shown in FIGS. 5 through 7 when the slot means 20 is located in the lower most edges 58, the guide support assembly will be moved upwardly into engagement with lower divider means 14.

To facilitate an engagement between the channel means 26 defined in the grid support assembly 24 and the slot means 20 defined in the lower divider means 14, a securement means 56 is included. This securement means 56 may take the form of a screw means 60 or a spring plunger means 62.

Figure 6:
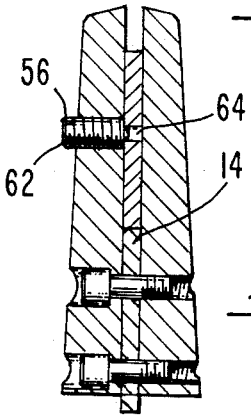
FIG. 6 is a cross sectional view through lines BB of FIG. 5 showing usage of a spring plunger means.

With the usage of the spring plunger means 62 as shown in FIG. 6, when the guide support assembly is placed into the slot means 20, the spring plunger means 62 will engage or abut against the lower plate means 16 and thereby engaging it for detachable securement of the guide support assembly with respect thereto. To facilitate the securement, the lower plate means 16 will preferably include a securement aperture means 64 defined therein located immediately adjacent to the location of the spring plunger means when the guide support assembly is in the engaged position with respect to the lower divider means 14.

Figure 4:
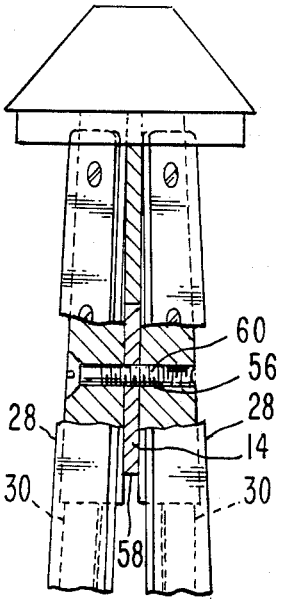
FIG. 4 is a cross sectional view of FIG. 2 through lines AA showing usage of a screw means.
Figure 5:
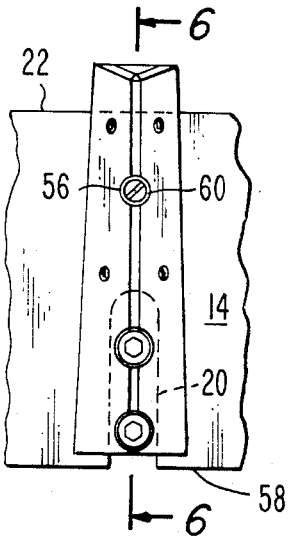
FIG. 5 is a front view of an embodiment of the present invention showing the slot means being located in the lower edges of the lower divider means.
Figure 7:
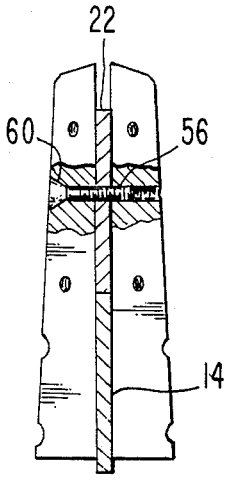
FIG. 7 is a cross sectional view through lines BB of FIG. 5 showing usage of a screw means.
Figure 8:
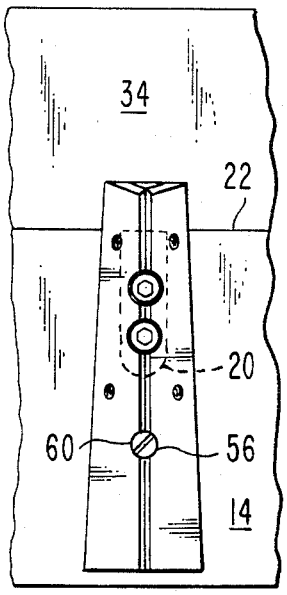
FIG. 8 is a front view of an embodiment of the present invention showing the slot means in the upper portion of the lower divider means, as well as inclusion of the upper divider means shown in place.
Figure 9:
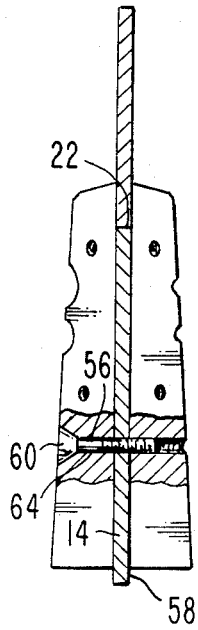
FIG. 9 is a cross sectional view of the embodiment shown in FIG. 8 through lines CC.
Figure 10:
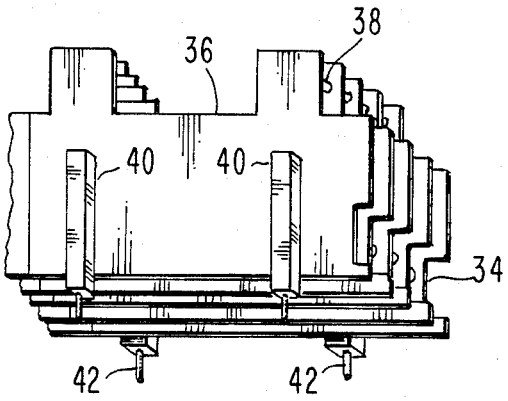
FIG. 10 is a bottom perspective view of the upper divider means and lateral retaining means of an embodiment of the present invention.
Figure 11:
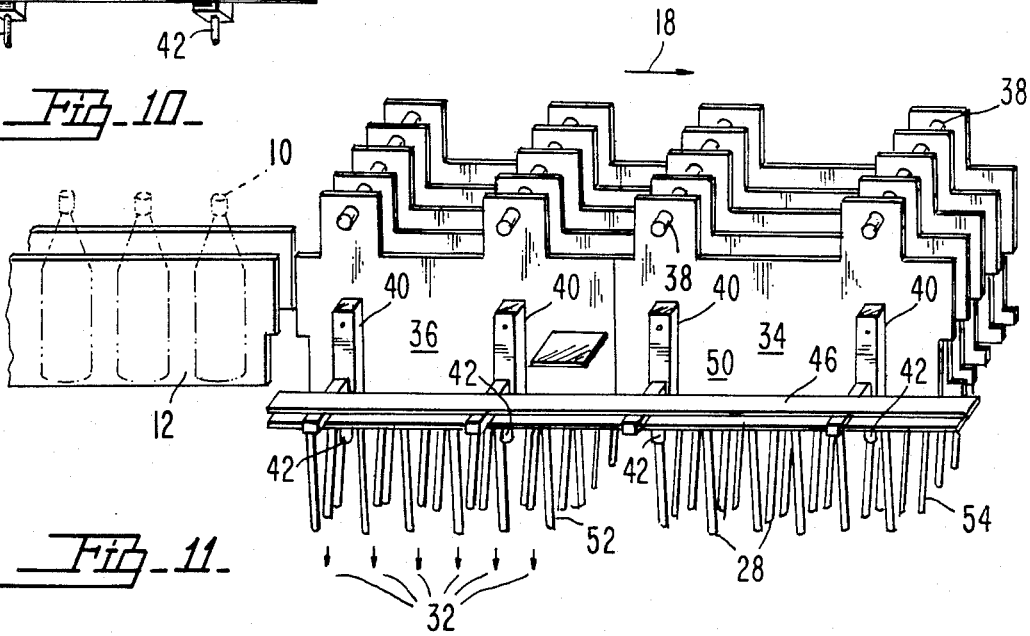
FIG. 11 is a perspective view of a double 4×6 loading packer assembly illustrating an embodiment of the present invention.
Figure 12:
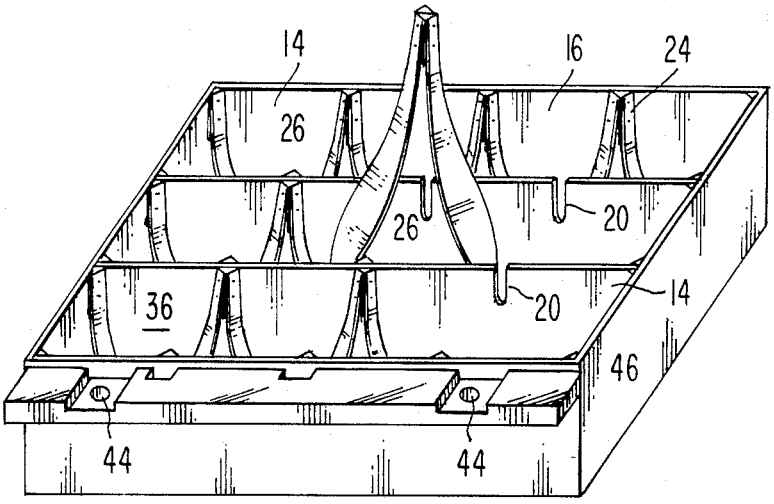
FIG. 12 is a top perspective illustration showing an embodiment of the lower divider means and carriage means of the present invention.
Figure 13:
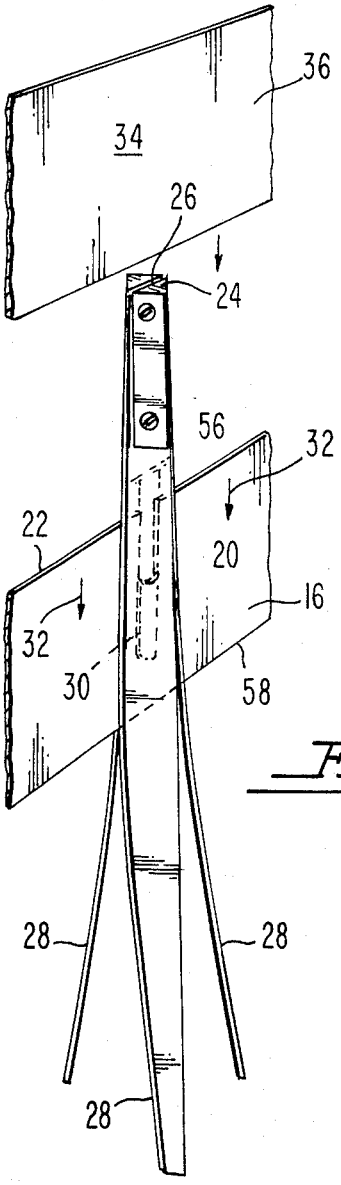
FIG. 13 is a perspective view showing assembly of the upper and lower plates to secure the guide support assembly in place in embodiment of the present invention.
Figure 14:
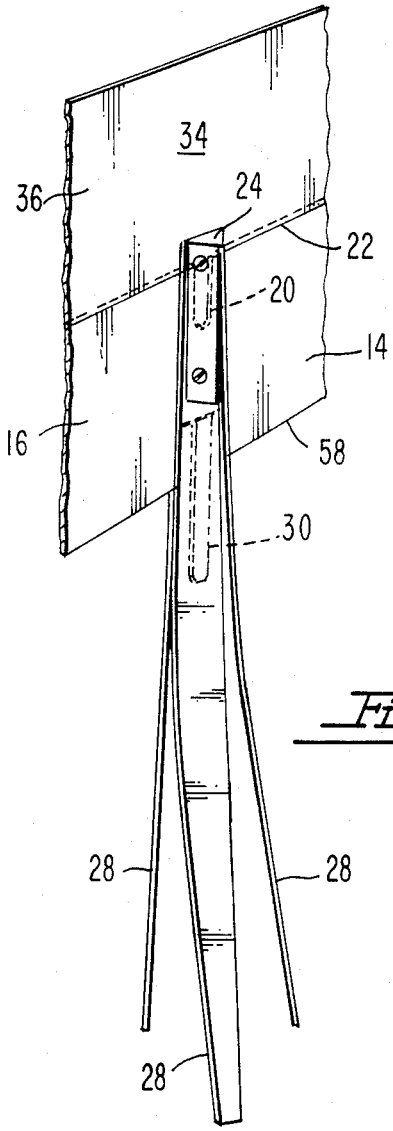
FIG. 14 is an illustration of the configuration showing FIG. 13 in the assembled position.

In the configuration of the securement means 56 utilizing the screw means 60, this engagement by the securement means is provided in an alternative fashion. In particular, the screw means 60 will extend through the guide support assembly 24 and into the securement aperture means 64 in the lower divider means 14 and thereby selectively retaining the guide support assembly 24 in place. This guide assembly can be removed by simple removal of this single screw means 60 and thereby allow the guide support assembly to be moved in an upward direction as shown in FIGS. 4 and 9, or in a downward direction as shown in FIG. 7.

In an alternative configuration, an upper divider means 34 will have a plurality of upper plate means 36 each maintained in spaced relationship with respect to one another by a lateral retaining means 38. The upper plate means divides the bottles into paths such that they can be spaced into rows of bottle receiving positions. Immediately below the upper divider means 34, is located the lower divider means 14. These plates are maintained in spaced relationship with respect to one another by a carriage means 46. This lower plate means 16 extends in a direction longitudinally with respect to the direction of movement 18 of the bottles on the supply conveyor. The lower plate means 16 are also positioned longitudinally with respect to the bottle movement direction 18, and are positioned immediately below and adjacent to the upper plate means 36.

The uppermost edges 22 of the lower plate means can define the slot means 20 which may start from the uppermost edges 22 and extend downwardly to an intermediate depth along the lower plate means 16. These slot means 20 are adapted to receive guiding assemblies for guiding of bottles as they travel downwardly into a predefined array as required. These guiding assemblies take the form of guide support assemblies 24.

Each guide support assembly defines a channel means 26 therein which is adapted to be placed into slot means 20 for fixedly securing the guide support assemblies 24 with respect to the lower plate means 16. A portion of the channel means 26, as well as a portion of the guide support assembly 24, will extend above the uppermost edges 22 of the lower plate means 16. In this manner, when the upper divider means 34, as retained by the lateral retaining means 38, is placed downwardly so that the lower most edges of the upper plates 36 and the uppermost edges of the lower plates 16 contact one another, the lower portion of the upper plates will extend into the channel means 26 thereby locking the individual guide support assemblies 24 in place.

Each guide support assembly includes a plurality of surfaces extending down both sides of the lower plate means 26 and carries thereon a plurality of guiding fingers 28 which may be of any suitable soft material such as plastic. To maintain a configuration of guiding fingers 28, a resilient reinforcement means 30 may be positioned therebehind. In this manner, a plurality of bottle guiding paths 32 are defined for urging bottles to be properly oriented into the predefined array which may be 3×4, 4×4, 4×6 or double 4×6 which is matching the bottle receiving case positioned therebelow.

Figure 3:
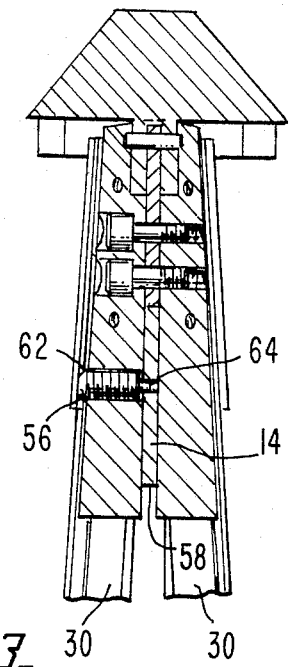
FIG. 3 is a cross sectional view of FIG. 2 through lines AA showing usage of a spring plunger means.
Figure 1:
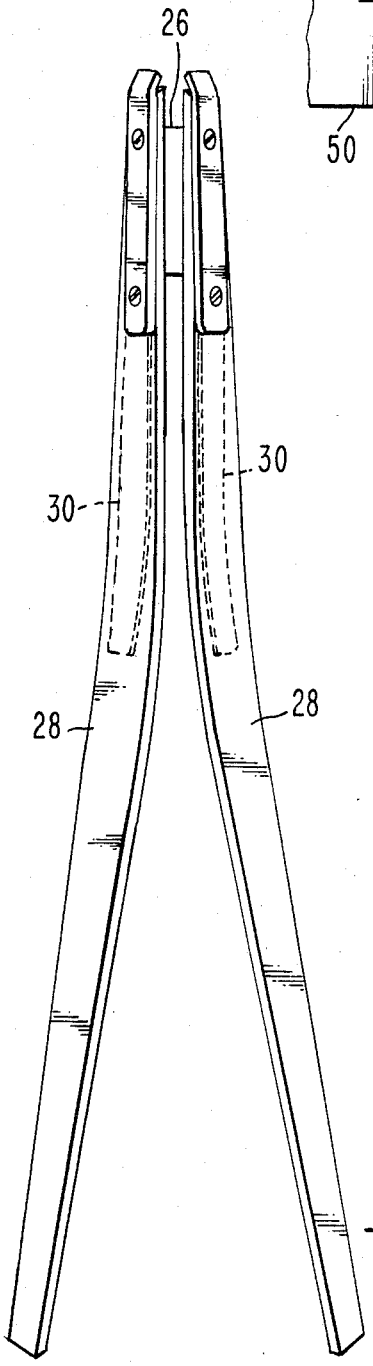
FIG. 1 is a front plan view of an embodiment of the guide support assembly of the present invention.

To facilitate securement and proper orientation of the lower divider means 14 with respect to the upper divider means 34, an alignment means 40 may be included with respect to the lateral retaining means 38. In one configuration as shown in FIG. 3 and FIG. 4, pin means 42 may be fixedly secured with respect to the lateral retaining means 38 and with respect to the upper divider means 34, and may be adapted to be placed into alignment apertures 44 defined by the carriage means 46 fixedly with respect to the lower divider means 14. When pin means 42 are placed into alignment apertures 44, correct vertical or horizontal alignment between the lower plate means 16 and upper plate means 36 will be achieved.

In a preferred configuration of the present application as shown in FIG. 4, it is desirable that two similarly configured arrays of packing configurations be placed immediately adjacent to one another downstream with respect to the bottle supply conveyor 12. In this configuration, the upper divider means 34 will define a first upper section 48 and a second upper section 50. Similarly, the lower divider means 14 will define a first lower section 52 and a second lower section 54. The first upper section 48 will be positioned immediately above the first lower section 52 to define an array of preferably 4×6 bottles for a 4×6 case. Similarly, the second upper section 50 will be positioned immediately above the second lower section 54 to also define another array of preferably 4×6. In this manner, 48 bottles can be packed at the same instant.

One of the main advantages of the present configuration is the utilization of the upper divider means 34, and in particular, the lower edges of the upper plate means 36 as the locking mechanism for the holding of the grid support assembly 24 in place. The primary maintenance requirement of this now standard configuration for packing of bottles is the replacement of the plastic and/or metal guiding fingers 38 or the resilient reinforcement means 30. The present invention greatly facilitates this replacement by allowing all of the guide support assemblies 24 to be instantly unlocked by simple removal of the upper divider means 34 which is interconnected by the lateral retaining means 38. Merely lifting of this lateral retaining means which is shown in FIG. 4 as a horizontally extending bar positioned at four locations, allows the individual guide supports 24 to be removed simply by lifting vertically. In this manner, individual guiding fingers 28 or resilient reinforcement means 30 may be conveniently replaced. Also, the relocking of all of the guide support assemblies 24 is made simple merely by the replacement of the upper divider means 34 of that particular assembly.

This convenience of replacement minimizes down time significantly and greatly facilitates ease of operation. Also, the use of a first upper section and first lower section 48 and 52 in combination with a second upper section 50 and a second lower section 54, increases packing speeds since two 4×6 cases can be packed simultaneously.

While particular embodiments of this invention have been shown in the drawings and described above, it will be apparent, that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. A bottle divider grid assembly capable of disassembly for use with a horizontal bottle supply conveyor comprising:

(a) a lower divider means comprising a plurality of vertical lower plate means spatially disposed parallel with respect to one another extending longitudinally with respect to the direction of movement of the bottle supply conveyor, said lower plate means defining a plurality of slot means extending vertically therein;

(b) a plurality of grid support assemblies each defining a channel means extending vertically therethrough, said channel means adapted to interlock with said slot means of said lower divider means to be removably mounted into one of said slot means, each said grid support assembly including guiding fingers extending downwardly therefrom along each opposite side of said lower plate means to define an array of bottle guiding paths extending downwardly thereadjacent;

(c) a securement means for detachably retaining said grid support assembly with said channel means thereof extending into said slot means of said lower divider means comprising:

(1) an upper divider means comprising a plurality of upper plate means spatially disposed parallel with respect to one another extending longitudinally with respect to the direction of movement of the bottle supply conveyor and oriented immediately above and adjacent to said lower plate means, said upper plate means being engageable with respect to said grid support assemblies to urge same into position retained in said slot means;

(2) lateral retaining means secured with respect to each of said upper plate means for maintaining same in spaced parallel relationship with respect to one another and to facilitate removal of each of said upper plate means simultaneously for selective removal and replacement of said grid support assemblies and said guiding fingers; and (3) an alignment means secured with respect to said upper divider means to maintain correct orientation between said upper plate means and said lower plate means.

2. The bottle guide support assembly as defined in claim 1 wherein said alignment means comprises a pin means being engageable with respect to said lower divider means to maintain alignment of said upper plate means parallel to and immediately above said lower plate means.

3. The bottle guide support assembly as defined in claim 1 wherein said upper plate means is adapted to selectively extend into said channel means of said guide support assembly positioned in said slot means of said lower divider means to selectively securely orient said grid support assemblies.

4. The bottle guide support assembly as defined in claim 1 wherein said guide support assemblies define three rows of four bottle guiding paths each.

5. The bottle guide support assembly as defined in claim 1 wherein said guide support assemblies define four rows of four bottle guiding paths each.

6. The bottle guide support assembly as defined in claim 2 further including a carriage means for maintaining position and orientation of said lower divider means with respect to one another and further defining alignment apertures therein adapted to receive said pin means therein to selectively fix orientation of said upper divider means with respect to said lower divider means.

7. The bottle guide support assembly as defined in claim 1 wherein said upper divider means includes a first upper section and a second upper section and said lower divider means including a first lower section and a second lower section immediately adjacent one another longitudinally with respect to the direction of movement of the bottle supply conveyor, said first lower section with said first upper section and said second lower section with said second upper section defining two adjacent 4×6 arrays of bottle guiding paths.

8. The bottle guide support assembly as defined in claim 1 wherein said downwardly extending guiding fingers are of plastic material.

9. The bottle guide support assembly as defined in claim 1 further including resilient reinforcement means adjacent to each of said guiding fingers to facilitate urging of bottles downwardly through said bottle guiding paths.

10. The bottle divider grid assembly as defined in claim 1 wherein said slot means are defined extending vertically downwardly from the upper edges of said lower divider means.

11. The bottle guide support assembly as defined in claim 10 wherein said securement means comprises a spring plunger means mounted within said guide support assemblies to be biased against said divider means to detachably secure said channel means of said guide support assembly within said slot means of said lower divider means.

12. The bottle guide support assembly as defined in claim 11 wherein said lower divider means defines a securement aperture means therein adjacent to said spring plunger means to receive said spring plunger means biased thereinto when said channel means of said guide support assembly is secured with respect to said slot means of said lower divider means to facilitate detachable securement therebetween.

13. The bottle guide support assembly as defined in claim 10 wherein said securement means comprises a screw means mounted within said guide support assemblies to be secured into said divider means to detachably secure said channel means of said guide support assembly within said slot of said lower divider means.

14. The bottle divider grid assembly as defined in claim 13 wherein said lower divider means defines a securement aperture means therein adjacent to said screw means to receive said screw means extending therein when said channel means of said grid support assembly is secured with respect to said slot means of said lower divider means to facilitate detachable securement therebetween.

15. The bottle guide support assembly as defined in claim 1 wherein said slot means are defined extending vertically upwardly from the lower edges of said lower divider means.

16. The bottle guide support assembly as defined in claim 15 wherein said securement means comprises a spring plunger means mounted within said guide support assemblies to be biased against said divider means to detachably secure said channel means of said guide support assembly within said slot means of said lower divider means.

17. The bottle guide support assembly as defined in claim 16 wherein said lower divider means defines a securement aperture means therein adjacent to said spring plunger means to receive said spring plunger means biased thereinto when said channel means of said guide support assembly is secured with respect to said slot means of said lower divider means to facilitate detachable securement therebetween.

18. The bottle guide support assembly as defined in claim 15 wherein said securement means comprises a screw means mounted within said guide support assemblies to be secured into said divider means to detachably secure said channel means of said guide support assembly within said slot means of said lower divider means.

19. The bottle guide support assembly as defined in claim 18 wherein said lower divider means defines a securement aperture means therein adjacent to said screw means to receive said screw means extending therein when said channel means of said guide support assembly is secured with respect to said slot means of said lower divider means to facilitate detachable securement therebetween.

20. A bottle divider grid assembly capable of disassembly for use with a bottle supply conveyor comprising:

(a) a lower divider means comprising a plurality of lower plate means spatially disposed parallel with respect to one another extending longitudinally with respect to the direction of movement of the bottle supply conveyor, said lower plate means defining a plurality of slot means therein extending vertically from the uppermost edges of said lower plate means vertically downwardly therein;

(b) a plurality of grid support assemblies each defining a channel means extending vertically therethrough, said channel means adapted to interlock with said slot means for said grid support assemblies to be removably mounted into one of said slot means, each said grid support assembly including plastic guiding fingers extending downwardly therefrom along each opposite side of said lower plate means to define an array of bottle guiding paths extending downwardly thereadjacent, each of said guiding fingers including a resilient reinforcement means;

(c) an upper divider means comprising a plurality of upper plate means spatially disposed parallel with respect to one another extending longitudinally with respect to the direction of movement of the bottle supply conveyor and oriented immediately above and adjacent to said lower plate means, said upper divider means including a carriage means to maintain spaced orientation of said upper plate means with respect to one another, said carriage means further defining alignment apertures therein, said upper plate means being engageable with respect to said channel means of said grid support assemblies to urge same into position retained in said slot means;

(d) lateral retaining means secured with respect to each of said upper plate means for maintaining same in spaced parallel relationship with respect to one another and to facilitate removal of each of said upper plate means simultaneously for selective removal and replacement of said grid support assemblies and said guiding fingers; and (e) an alignment means secured with respect to said upper divider means to maintain correct orientation between said upper plate means and said lower plate means, said alignment means including a pin means secured with respect to said carriage means and adapted to be positioned extending into said alignment apertures to retain said upper plate means parallel to and immediately above said lower plate means.

21. The bottle guide support assembly as defined in claim 20 wherein said guide support assemblies define 3 rows of 4 bottle guiding paths each.

22. The bottle guide support assembly as defined in claim 20 wherein said guide support assemblies define 4 rows of 4 bottle guiding paths each.

23. A bottle divider grid assembly capable of disassembly for use with a bottle supply conveyor comprising:

(a) a lower divider means comprising a plurality of lower plate means spatially disposed parallel with respect to one another extending longitudinally with respect to the direction of movement of the bottle supply conveyor, said lower plate means defining a plurality of slot means therein extending vertically from the uppermost edges of said lower plate means vertically downwardly therein, said lower divider means including a first lower section and a second lower section immediately adjacent to one another spaced longitudinally in relationship to the direction of movement of the bottle supply conveyor;

(b) a plurality of grid support assemblies each defining a channel means extending vertically therethrough, said channel means being vertically engageable with respect to said slot means for said grid support assemblies to be removably mounted into one of said slot means, each said grid support assembly including plastic guiding fingers extending downwardly therefrom along each opposite side of said lower plate means to define an array of bottle guiding paths extending downwardly thereadjacent, each of said guiding fingers including a resilient reinforcement means;

(c) an upper divider means comprising a plurality of upper plate means spatially disposed parallel with respect to one another extending longitudinally with respect to the direction of movement of the bottle supply conveyor and oriented immediately above and adjacent to said lower plate means, said upper divider means including a carriage means to maintain spaced orientation of said upper plate means with respect to one another, said carriage means further defining alignment apertures therein, said upper plate means adapted to extend into said channel means of said grid support assemblies to urge same down into position retained in said slot means, said upper divider means including a first upper section and a second upper section immediately adjacent to one another longitudinally with respect to the direction of the movement of the bottle supply conveyor, with said first upper section located immediately above and parallel with respect to said first lower section and with said second upper section and with said second upper section also located immediately above and parallel with respect to said second lower section to define two adjacent arrays of bottle guiding paths.

24. The bottle guide support assembly as defined in claim 1 wherein the arrays of bottle guiding paths defined by said first upper section and first lower section is a $4\times6$ array, and the array defined by said second upper section and second lower section is also a $4\times6$ array.

* * * * *